US006504507B2

(12) United States Patent
Geeraert

(10) Patent No.: US 6,504,507 B2
(45) Date of Patent: Jan. 7, 2003

(54) ANTENNA TUNING

(75) Inventor: Francis Geeraert, Deinze (BE)

(73) Assignee: Nokia Mobile Phones Limited, Espoo (FI)

( * ) Notice: Subject to any disclaimer, the term of this patent is extended or adjusted under 35 U.S.C. 154(b) by 15 days.

(21) Appl. No.: 09/779,858

(22) Filed: Feb. 9, 2001

(65) Prior Publication Data

US 2002/0109635 A1 Aug. 15, 2002

(51) Int. Cl.[7] ..... H01Q 1/38
(52) U.S. Cl. ..... 343/700 MS; 343/702; 343/745
(58) Field of Search ..... 343/700 MS, 702, 343/745, 829, 756; H01Q 1/36, 1/38

(56) References Cited

U.S. PATENT DOCUMENTS 5,734,350 A * 3/1998 Deming et al. ..... 343/700 MS
5,777,581 A * 7/1998 Lilly et al. ..... 343/700 MS
6,002,370 A * 12/1999 Mckinnon et al. ... 343/700 MS
6,150,984 A * 11/2000 Suguro et al. ..... 343/702
6,366,254 B1 * 4/2002 Sievenpiper et al. ..... 373/770

* cited by examiner

*Primary Examiner*—Tho Phan
(74) *Attorney, Agent, or Firm*—Antonelli, Terry, Stout & Kraus, LLP

(57) ABSTRACT

A patch antenna is provided with two feed points, one on either side of a cut-out. Both feed points are connected to the ports on a first side of a matrix switch, one directly and one via a capacitor. An antenna feed is connected to one of the ports on a second side of the matrix switch, while the other is earthed. In use, a controller operates the switch so that the antenna feed is connected one or other of the feed points, each giving rise to a different resonant frequency and so providing a way of tuning the antenna for small frequency shifts.

10 Claims, 11 Drawing Sheets

ANTENNA TUNING

FIELD OF THE INVENTION

This invention relates to antenna tuning, particularly but not exclusively to tuning a patch antenna using a switch.

BACKGROUND

Patch antennas are well-known and are well-suited for use as internal antennas in mobile telephones, since they can be made relatively small.

The problem with patch antennas is the need to trade-off size and bandwidth, since, in general, the smaller the antenna, the smaller its bandwidth. Since antennas need to be small to fit within modern mobile telephones, a solution is required to the problem of providing sufficient bandwidth for effective operation, including operation across multiple bands. There are two possible approaches to solving this problem, the first being to use multiple antennas and the second being to use a variable tuning scheme, so that the antenna can be made to cover different frequency bands.

SUMMARY OF THE INVENTION

In accordance with the invention, there is provided a tunable antenna for a portable communications device, comprising an antenna arrangement comprising first and second spaced apart conductors, the first conductor comprising a radiating conductor and the second conductor comprising a ground plane, the radiating conductor including first and second feed points arranged such that a resonant frequency of the antenna arrangement when fed at the first feed point is different from a resonant frequency of the antenna arrangement when fed at the second feed point, further comprising a switch for switching between the first and second feed points.

According to the invention, there is further provided a tunable antenna for a portable communications device, comprising an antenna arrangement connectable to an antenna feed, the antenna arrangement comprising first and second spaced apart conductors, the first conductor comprising a radiating conductor and the second conductor comprising a ground plane, the radiating conductor including first and second feed points; and a capacitor having first and second terminals, said first terminal of said capacitor being connected to said first feed point, further comprising a switch arranged to selectively switch the antenna feed between said second terminal of said capacitor and said second feed point.

The invention further provides a method of tuning an antenna for a portable communications device, the antenna comprising first and second spaced apart conductors, the first conductor comprising a radiating conductor and the second conductor comprising a ground plane, the radiating conductor including first and second feed points arranged such that a resonant frequency of the antenna arrangement when fed at the first feed point is different from a resonant frequency of the antenna arrangement when fed at the second feed point, the method including switching an antenna feed between the first and second feed points.

DESCRIPTION OF THE DRAWINGS

Embodiments of the invention will now be described by way of example, with reference to the accompanying drawings, in which.

DETAILED DESCRIPTION

Figure 1:
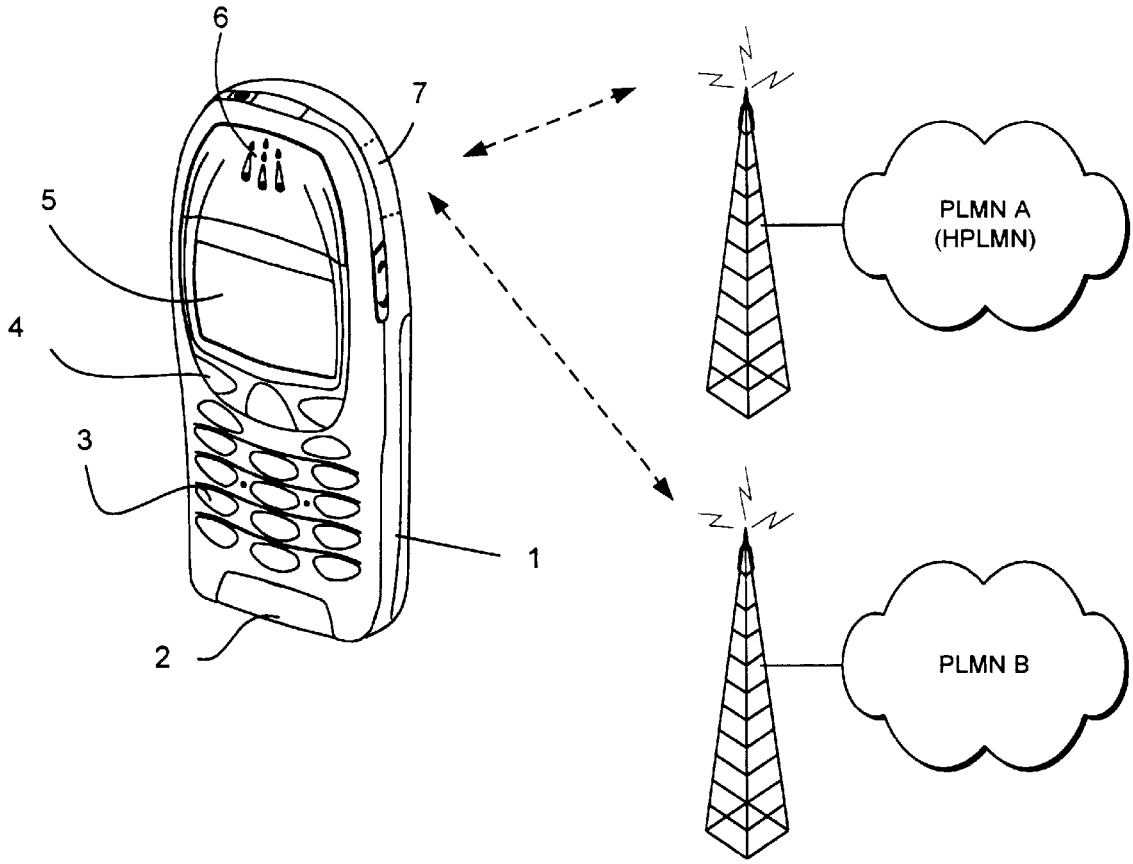
FIG. 1 is a perspective view of a mobile telephone handset.
Figure 2:
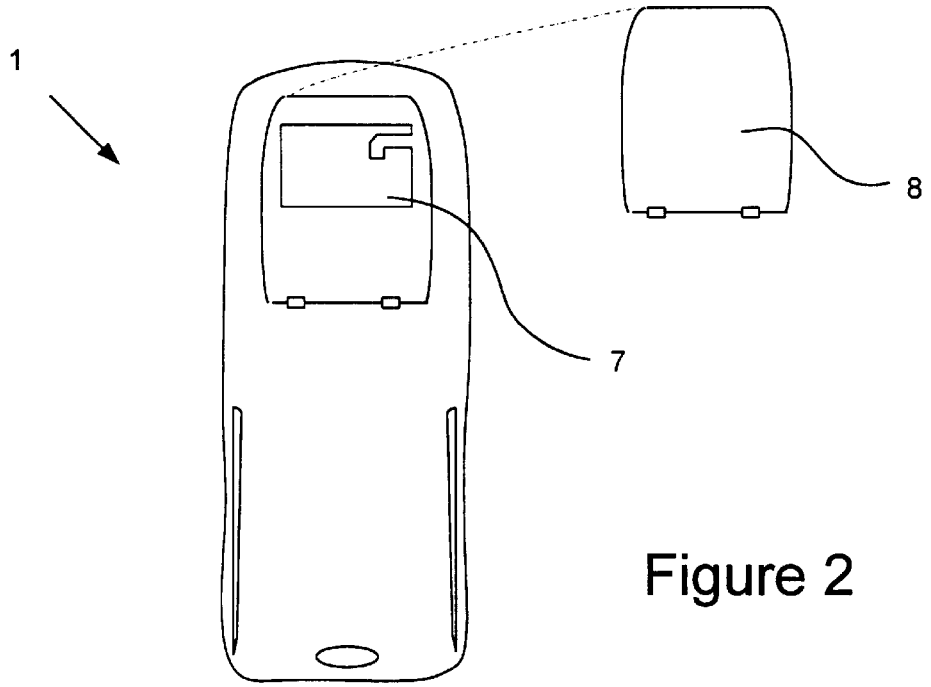
FIG. 2 is a rear view of the handset of FIG. 1.

Referring to FIG. 1, a mobile station in the form of a mobile telephone handset 1 includes a microphone 2, keypad 3, with soft keys 4 which can be programmed to perform different functions, an LCD display 5, a speaker 6 and a tunable patch antenna 7 which is contained within the housing. The location of the antenna 7 is illustrated in FIG. 2, which shows the back of the handset 1 with a rear cover 8 removed.

The mobile station 1 is operable in different configurations to communicate through cellular radio links with individual PLMNs (public land mobile network) shown schematically as PLMN A and PLMN B. PLMNs A and B may utilise different frequency bands. For example, PLMN A may be a GSM 1800 MHz network while PLMN B is a GSM 1900 MHz network.

Generally, the handset communicates over a cellular radio link with its home network PLMN A (shown as HPLMN) in a first configuration i.e. using a frequency band appropriate to PLMN A. However, when the user roams to PLMN B, one of the keys on the handset, for example, one of the soft keys 4, may be operated to select a second operational configuration i.e. a frequency band associated with PLMN B.

Figure 3:
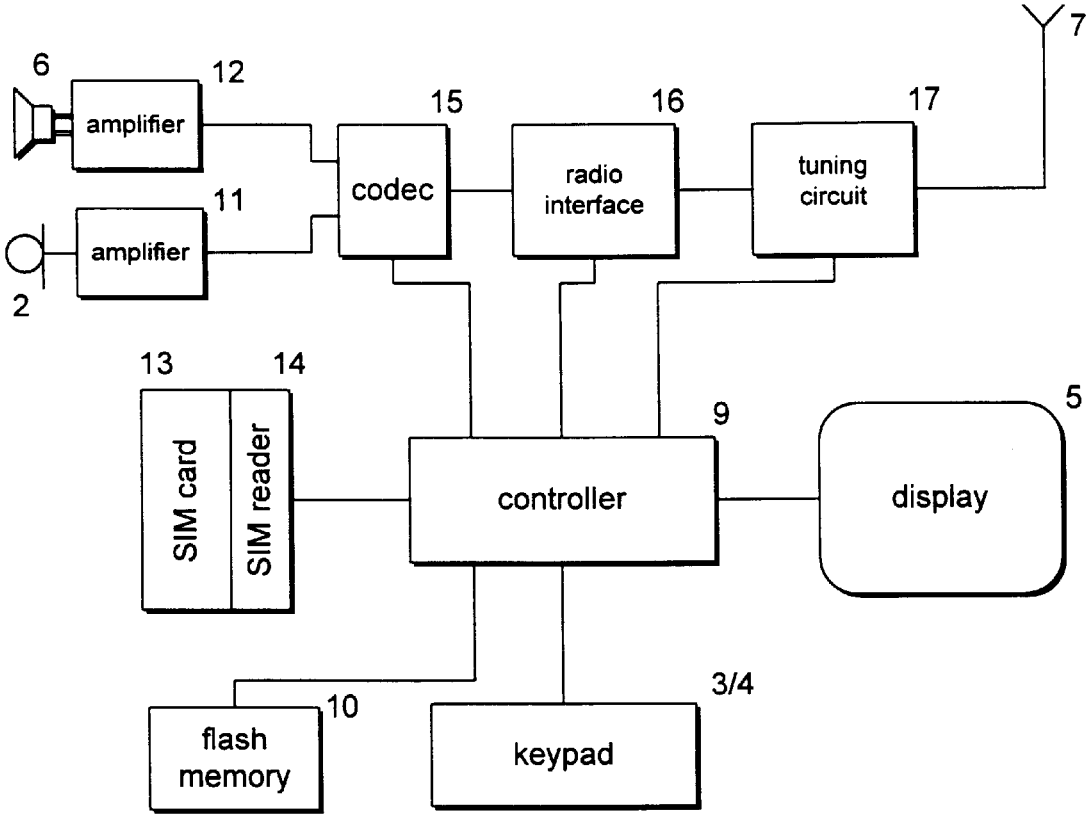
FIG. 3 is a schematic diagram of mobile telephone circuitry for use in the telephone handset of FIG. 1.

FIG. 3 illustrates the major circuit components of the telephone handset 1. Signal processing is carried out under the control of a digital micro-controller 9 which has an associated flash memory 10. Electrical analogue audio signals are produced by microphone 2 and amplified by pre-amplifier 11. Similarly, analogue audio signals are fed to the speaker 6 through an amplifier 12. The micro-controller 9 receives instruction signals from the keypad and soft keys 3, 4 and controls operation of the LCD display 5.

Information concerning the identity of the user is held on a smart card 13 in the form of a GSM SIM card which contains the usual GSM international mobile subscriber identity (IMSI) and an encryption key $K_i$ that is used for encoding the radio transmission in a manner well known per se. The SIM card is removably received in a SIM card reader 14.

The mobile telephone circuitry includes a codec 15, an rf stage 16 and an antenna tuning circuit 17 feeding the tunable antenna 7.

For example, for operation in a first frequency band, the codec 15 receives analogue signals from the microphone amplifier 11, digitises them into a GSM signal format and feeds them to the rf stage 16 for transmission through the antenna 7 to PLMN A shown in FIG. 1. Similarly, signals received from PLMN A are fed through the antenna 7 to be demodulated in the rf stage 16 and fed to codec 15, so as to produce analogue signals fed to the amplifier 12 and earpiece 6. The tuning circuit 17 tunes the antenna under the control of the controller 9 to the required frequency band for the operational configuration.

As mentioned above, with a conventional dual band/mode phone, when the user roams from the coverage area of PLMN A to PLMN B, the configuration suitable for PLMN B may be manually selected by means of a soft key 4, or can be automatic if the coverage areas for PLMN A and B do not overlap.

Figure 4:
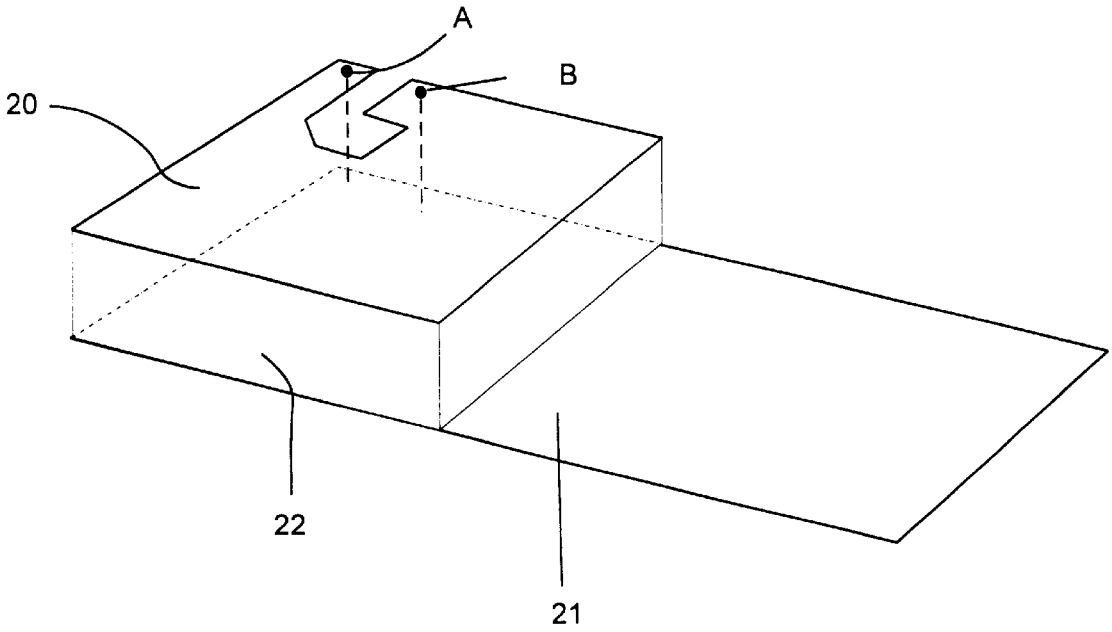
FIG. 4 shows the structure of a tunable patch antenna in accordance with the invention.

Referring to FIG. 4, a tunable antenna 7 according to the invention comprises a conductive patch element 20 spaced 5 mm from a ground plane 21 which comprises the PCB to which the handset components are mounted. The ground plane 21 has a rectangular shape approximately 105 mm long by 40 mm wide. The space between the patch element 20 and the PCB 21 is filled with a dielectric material 22, such as a PVC foam. The patch element 20 includes first and second feed points A, B.

Figure 5:
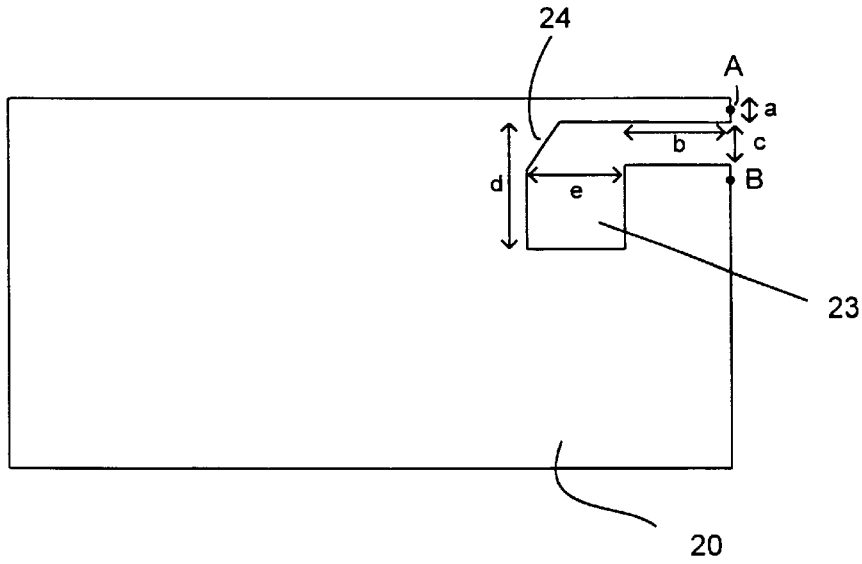
FIG. 5 is a top view of the patch antenna element shown in FIG. 4.

A top view of the patch antenna element 20 is shown in FIG. 5. The patch antenna element 20 is, for example, a rectangular element which contains an approximately L-shaped cut-out 23 at one end. The cut-out starts along one of the shorter edges and comprises a rectangular stem portion which extends into an approximately rectangular body portion, one corner 24 of which is angled.

It will be understood that the shape of the cut-out affects the values of the inductances L1 and L2 and the capacitance Cp, so that the specified shape is given by way of example only and is limited only by the need to achieve particular values of capacitance and inductance to implement a given antenna circuit.

As mentioned above, two feed points respectively labelled A and B are situated along the first edge 23 of the antenna patch 20 on either side of the cut-out.

Figure 6:
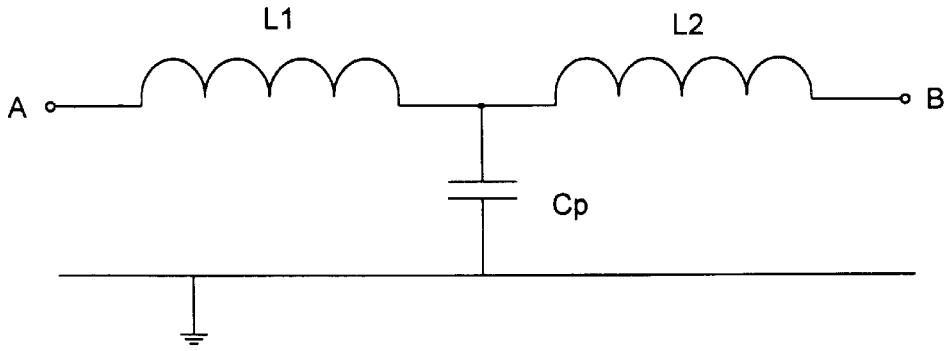
FIG. 6 is a schematic diagram showing a simplified equivalent circuit for the antenna of FIG. 4.

FIG. 6 is a schematic diagram showing a simplified equivalent circuit for the antenna structure of FIG. 4. The patch structure can be modelled as a reactive network comprising an inductor L1, one end of which is connected to feed point A, and an inductor L2, one end of which is connected to feed point B, the other ends of inductors L1 and L2 being connected to one end of a capacitor Cp, the other end of which is connected to ground.

Figure 7:
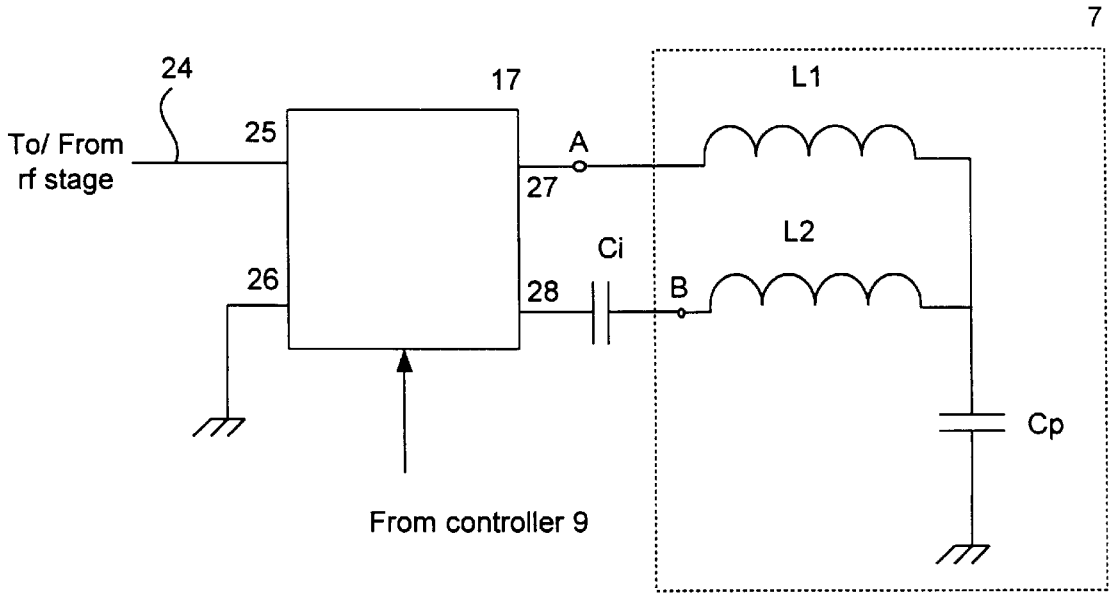
FIG. 7 is a schematic diagram showing the circuit of FIG. 6 connected to an rf stage shown in FIG. 3 via a matrix switch.

FIG. 7 shows the connection of the rf stage 16 to the antenna 7 via a tuning circuit 17 which comprises a switch, for example, a matrix switch. The antenna 7 is represented by its equivalent circuit as shown in FIG. 6. An antenna feed 24 is connected to a first switch port 25 on a first switching side of the matrix switch 17.

A second switch port 26 on the first switching side of the matrix switch is earthed. A third switch port 27 on a second switching side of the matrix switch is connected to feed point A of the antenna 7. A fourth switch port 28 on the second switching side of the matrix switch is connected to the second feed point B of the antenna 7 via a series capacitance Ci. It will be understood that the antenna feed 24 can be an output from the rf stage 16, for example a power amplifier output, or can comprise the rf stage receive circuitry for receiving signals picked up by the antenna 7. For signals fed from the rf stage to the antenna 7, the first and second switch ports comprise input ports and the third and fourth switch ports comprise output ports, whereas for signals fed from the antenna 7 to the rf stage 16, the first and second switch ports comprise output ports and the third and fourth switch ports comprise input ports.

Figure 8A:
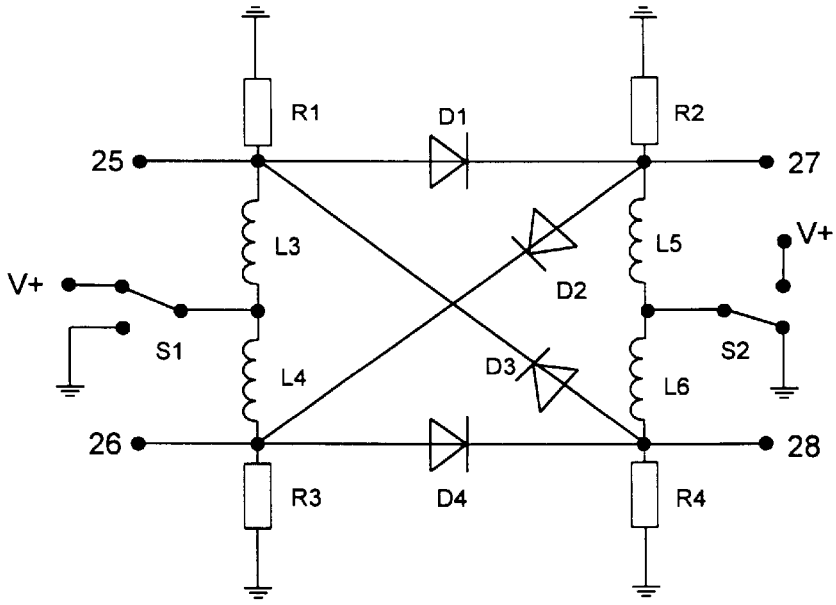
FIG. 8*a* is a schematic circuit diagram of the matrix switch shown in FIG. 7 in the first switching configuration shown in FIG. 10*a;*
Figure 8B:
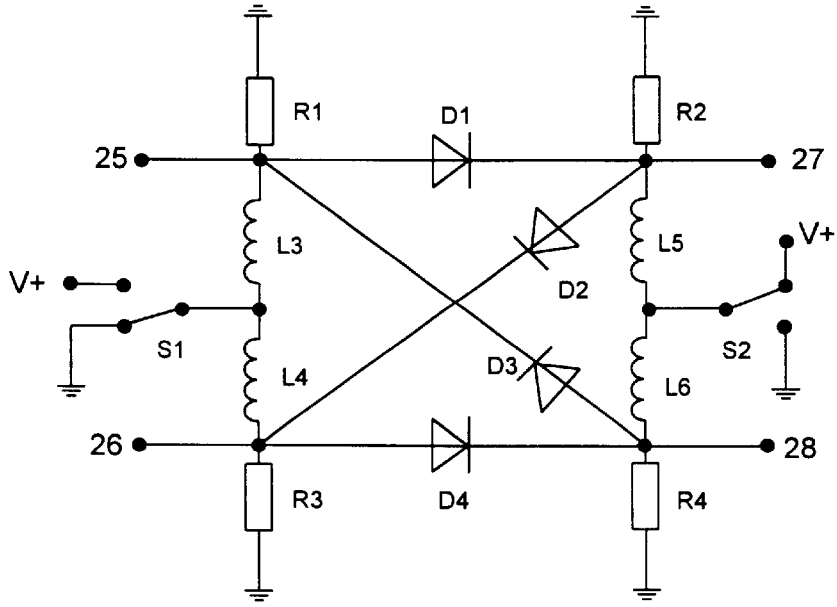
FIG. 8*b* is a schematic circuit diagram of the matrix switch shown in FIG. 7 in the second switching configuration shown in FIG. 10*b;*

FIGS. 8*a* and 8*b* are schematic diagrams of the matrix switch shown in FIG. 7, in two different switching configurations. As shown in the Figures, the matrix switch 17 comprises a switching arrangement of diodes D1–D4, inductors L3–L6, resistors R1–R4 and switches S1 and S2. The switches S1 and S2 are arranged to provide different switching configurations between the input ports 25, 26 and the output ports 27, 28.

Figure 9:
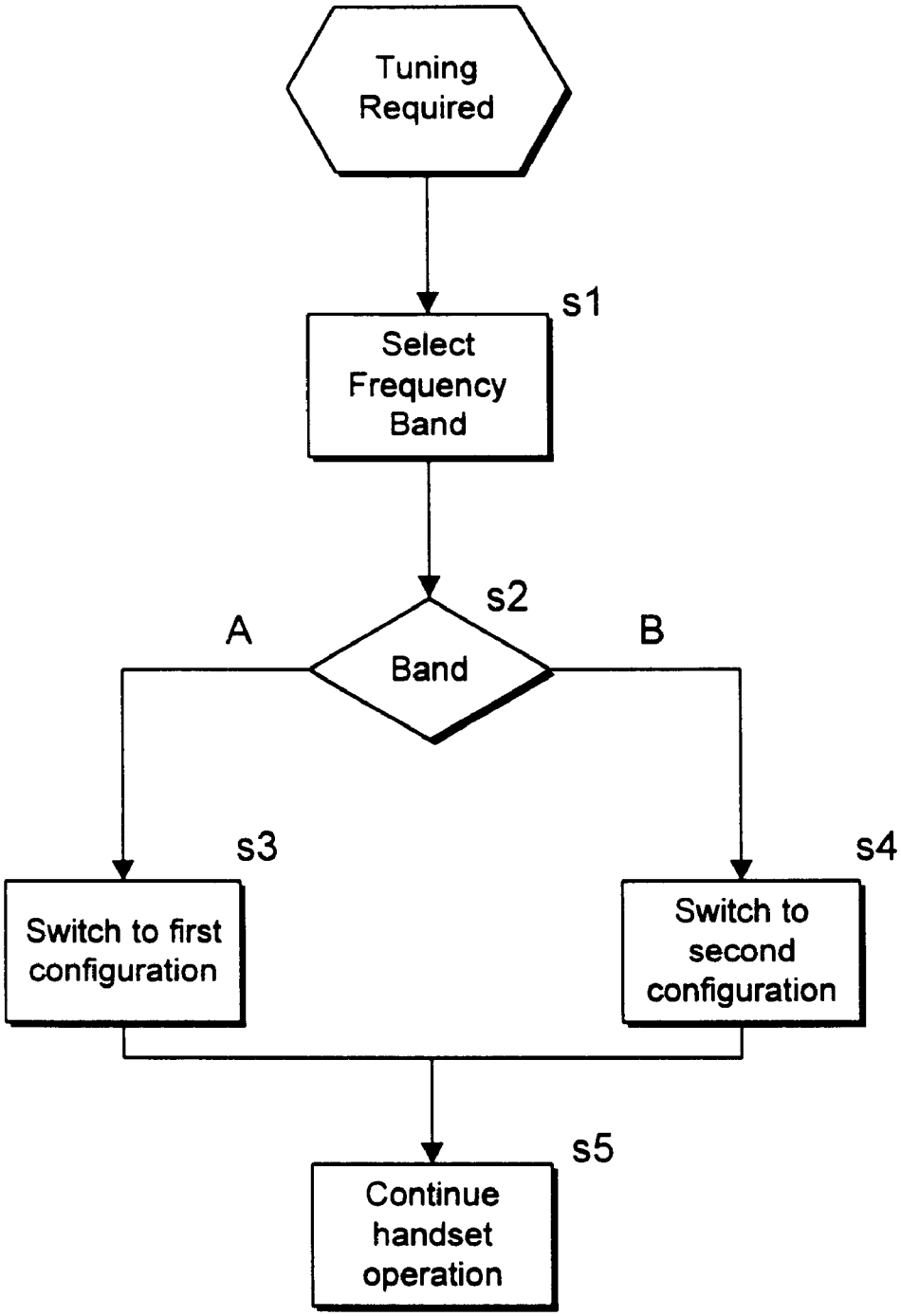
FIG. 9 illustrates a method of tuning an antenna according to the invention.

The tuning operation for the antenna 7 will now be described in detail, with reference to FIG. 9.

When tuning is required, for example to switch between networks operating in different frequency bands, a user selects a band A or B by using a soft key 4 (step s1). If he selects band A (step s2), the controller 9 switches the matrix switch 17 to a first switching configuration (step s3).

Figure 10A:
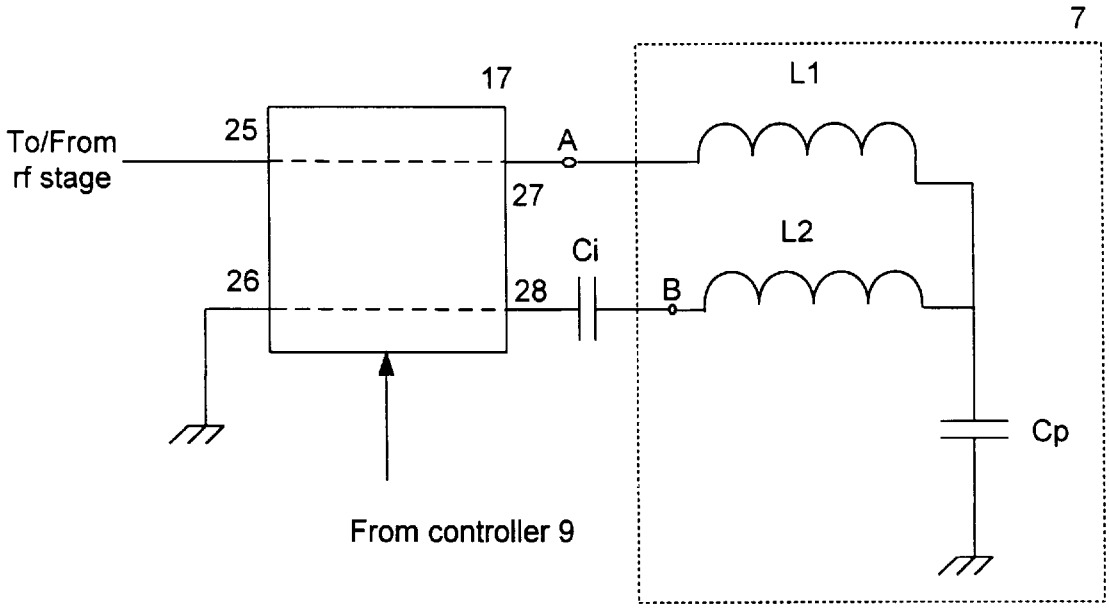
FIG. 10*a* is a schematic diagram illustrating a first switching configuration.
Figure 11A:
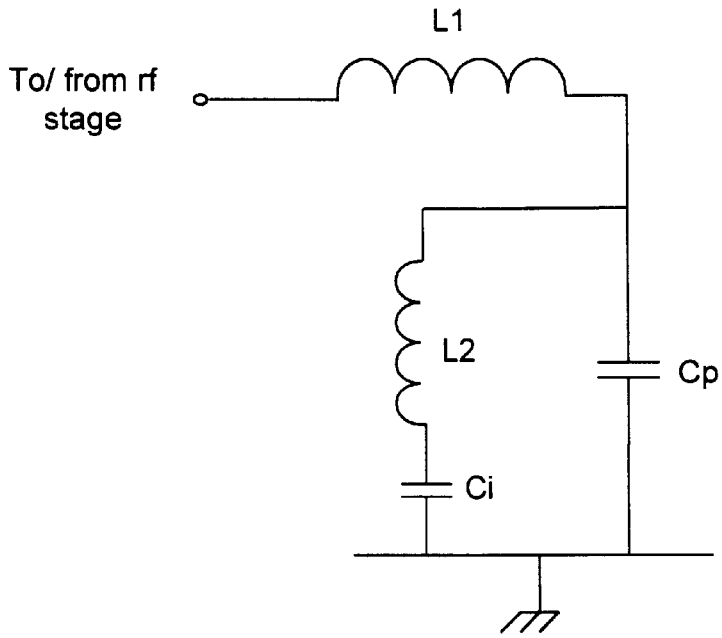
FIG. 11*a* is an equivalent circuit diagram corresponding to the first switching configuration illustrated in FIG. 10*a;*
Figure 12A:
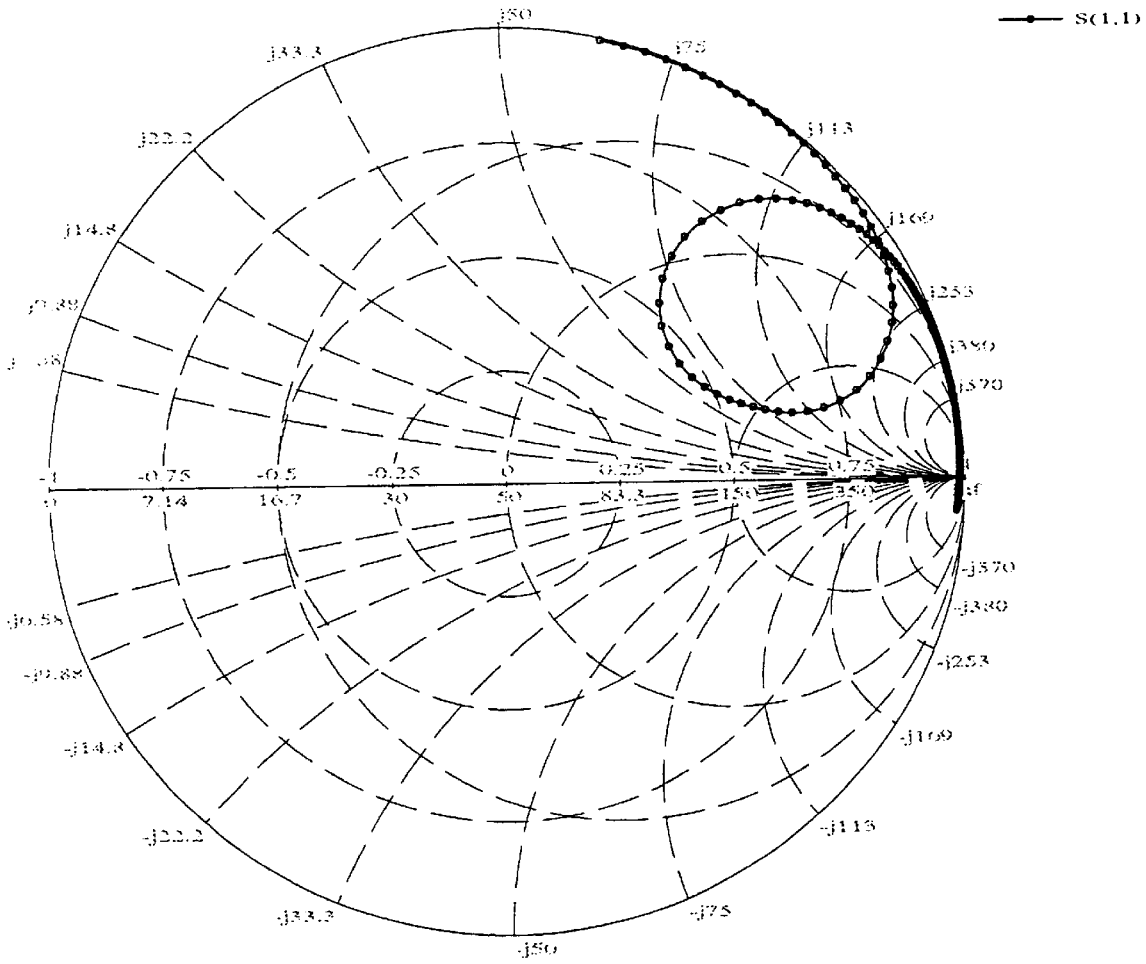
FIG. 12*a* is a Smith diagram for the first switching configuration.

FIG. 10*a* is a schematic diagram illustrating the first switching configuration. In this configuration, indicated by the dotted lines within the matrix switch, the output of the rf circuit is connected to feed point A while feed point B is connected to ground via the capacitor Ci. The equivalent circuit diagram for this configuration is shown in FIG. 11*a* while FIG. 12*a* shows the corresponding Smith diagram.

If the user selects operating mode B (step s2), the controller 9 switches the matrix switch 17 to a second switching configuration (step s4).

Figure 10B:
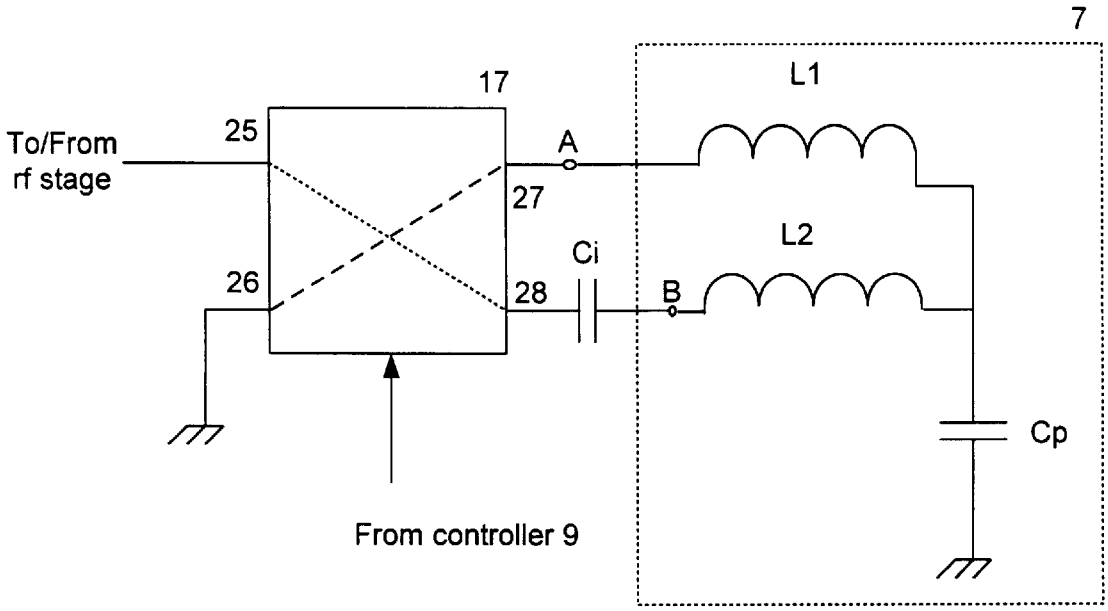
FIG. 10*b* is a schematic diagram illustrating a second switching configuration.

FIG. 10*b* is a schematic diagram illustrating the second switching configuration. In this configuration, the rf stage is connected to feed point B via the capacitor Ci, while feed point A is connected directly to ground. The equivalent circuit diagram corresponding to this configuration is shown in FIG. 11*b*, while FIG. 12*b* shows the Smith diagram for this configuration.

Once the frequency band has been selected and the switch position correspondingly set (steps s2–s4), handset transmit/receive operation continues with the new settings (step s5).

Figure 11B:
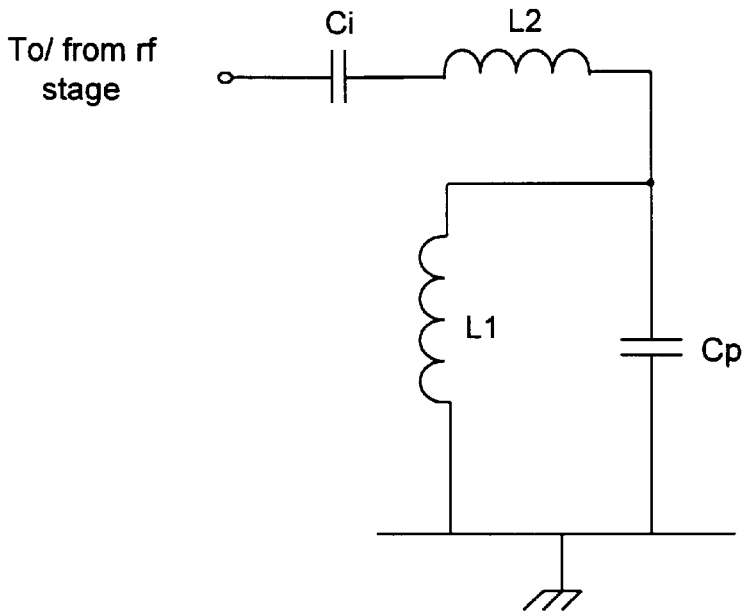
FIG. 11*b* is an equivalent circuit diagram corresponding to the second switching configuration illustrated in FIG. 10*b;*
Figure 12B:
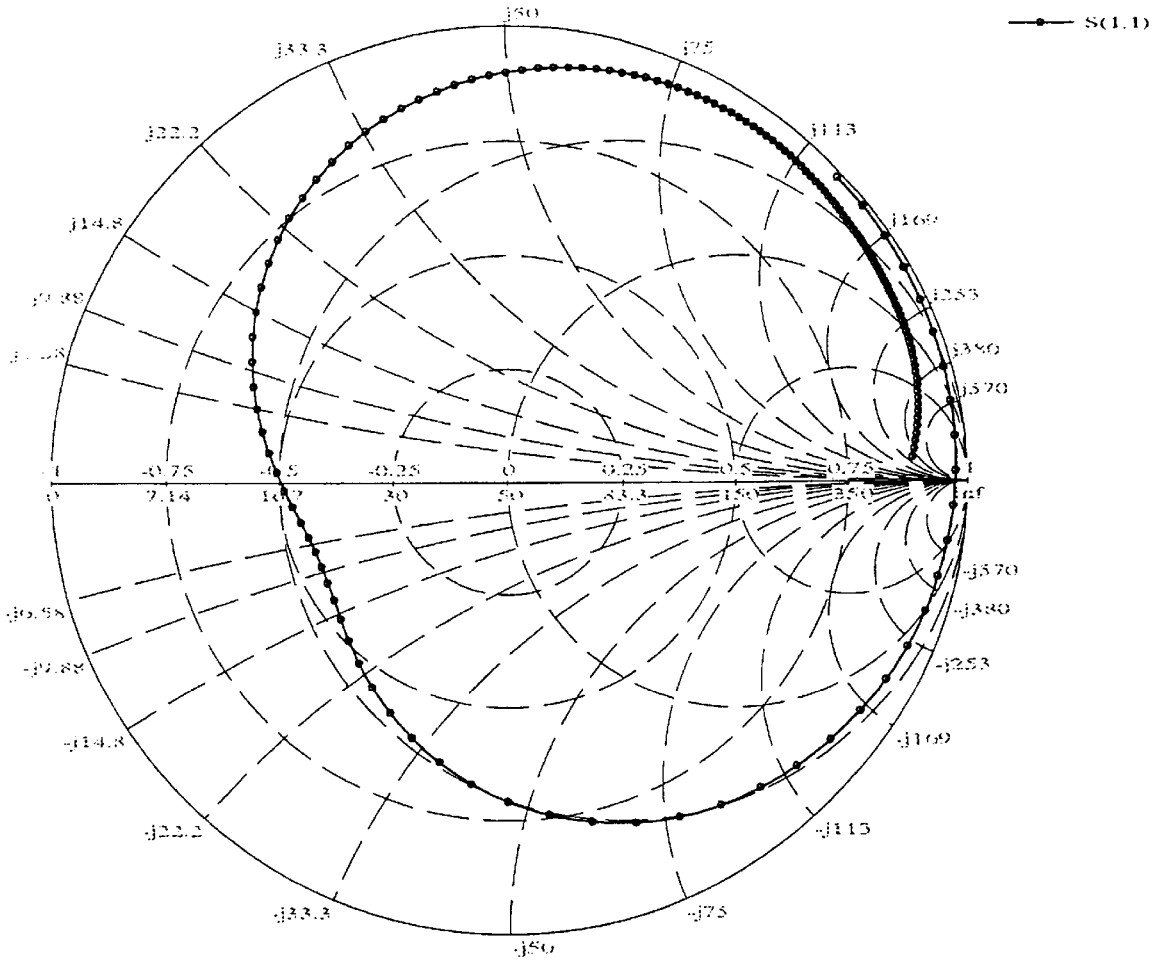
FIG. 12*b* is a Smith diagram for the second switching configuration.
Figure 13:
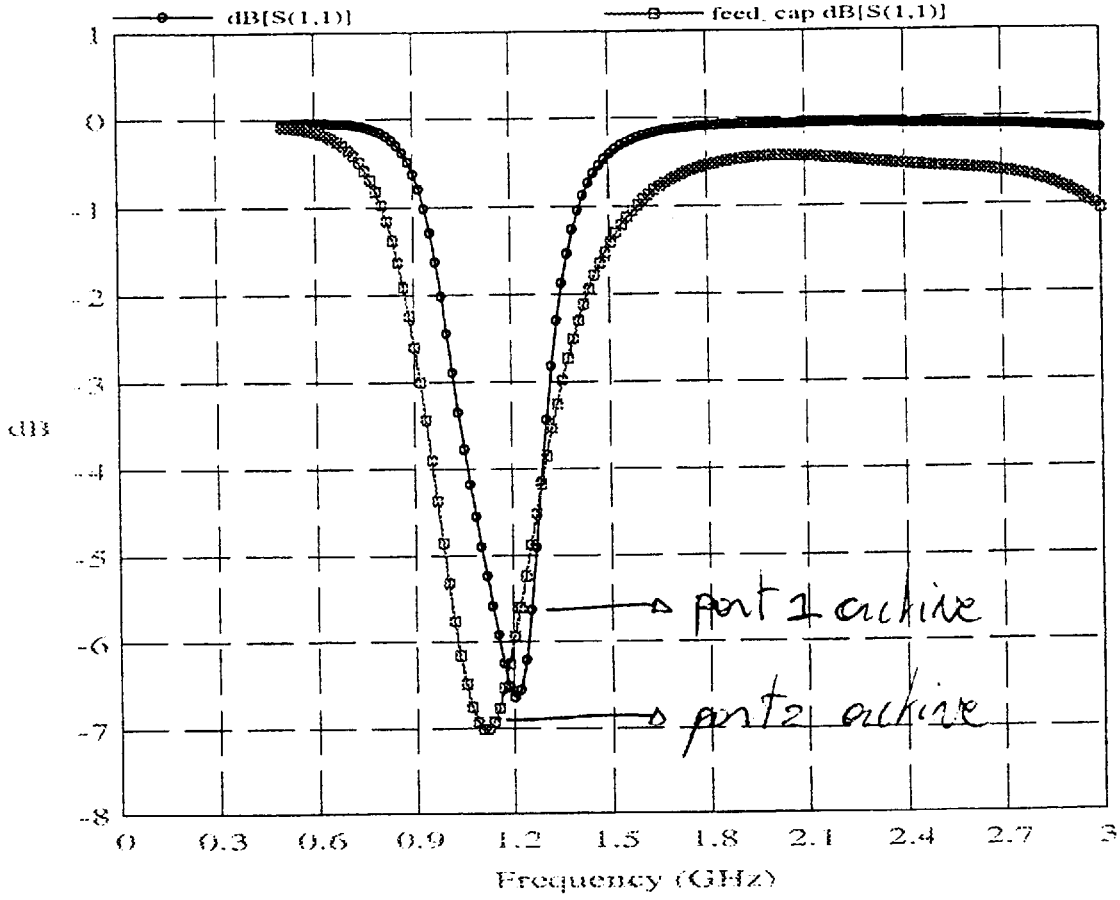
FIG. 13 illustrates the difference in resonant frequencies for each of the switching configurations shown in FIGS. 10*a* and 10*b*.

The equivalent circuit diagrams in FIGS. 11*a* and 11*b* show that the input impedance of the antenna circuit 7 differs for each configuration, leading to a difference in resonant frequencies for each configuration, as illustrated in FIG. 13.

For the first switching arrangement which corresponds to the plot shown as first plot 30, the resonant frequency of the antenna is 1.205 GHz, whereas for the second switching arrangement corresponding to second plot 31, the resonant frequency is 1.181 GHz. By tuning the frequency shift into the appropriate frequency bands, an antenna according to the invention can be used for switching between the GSM 1800/1900 frequency bands, as well as for switching between the frequencies used for the receive/transmit channels.

It will be understood that while the antenna arrangement has been described with detailed dimensions and relative arrangement of conductive plates, this is merely a specific example of the invention, and modifications to the structure, dimensions and precise arrangement of the components which do not alter the principles of operation also fall within the scope of this invention.

What is claimed is:

1. A tunable antenna for a portable communications device, comprising:

an antenna arrangement comprising first and second spaced apart conductors, the first conductor comprising a radiating conductor and the second conductor comprising a ground plane, the radiating conductor including first and second feed points arranged such that a resonant frequency of the antenna arrangement when fed at the first feed point is different from a resonant frequency of the antenna arrangement when fed at the second feed point, further comprising a switch for switching between the first and second feed points;

wherein the switch comprises first and second switch ports on a first switching side, wherein said first switch port is connected to an antenna feed and said second switch port is connected to a ground level;

wherein the switch further comprises third and fourth switch ports on a second switching side, the antenna further including a capacitor, wherein said third switch port is connected to said first feed point and said fourth switch port is connected via the capacitor to said second feed point.

2. A tunable antenna according to claim 1, wherein the first and second feed points are located on either side of a cut-out in the radiating conductor.

3. An antenna according to claim 2, wherein the shape of the cut-out is configured such that the resonant frequency when the antenna arrangement is fed at the first feed point is a GSM 1800 frequency band and the resonant frequency when the antenna arrangement is fed at the second feed point is a GSM 1900 frequency band.

4. An antenna arrangement according to claim 2, wherein the shape of the cut-out is configured such that the resonant frequency when the antenna arrangement is fed at the first feed point is a receive frequency for the portable communications device and the resonant frequency when the antenna arrangement is fed at the second feed point is a transmit frequency for the portable communications device.

5. An antenna according to claim 1, wherein the switch comprises a matrix switch.

6. An antenna according to claim 1, wherein the space between the first and second conductors is filled with a dielectric material.

7. An antenna according to claim 1, wherein the switch is operable in response to a control signal.

8. An antenna according to claim 1, wherein the first conductor comprises a substantially planar patch element.

9. A tunable antenna according to claim 1, a second terminal of the capacitor being connected to the second feed point, and a first terminal of the capacitor being connectable to the antenna feed.

10. A method of tuning an antenna for a portable communications device, the antenna comprising first and second space apart conductors, the first conductor comprising a radiating conductor and the second conductor comprising a ground plane, the radiating conductor including first and second feed points arranged such that a resonant frequency of the antenna arrangement when fed at the first feed point is different from a resonant frequency of the antenna arrangement when fed at the second feed point, the method including switching an antenna feed between the first and second feed points;

wherein the antenna further comprises a capacitor having first and second terminals, said second terminal being connected to the second feed point, and said first terminal being connectable to the antenna feed.

* * * * *